US007069642B2

(12) United States Patent
Bower et al.

(10) Patent No.: US 7,069,642 B2
(45) Date of Patent: Jul. 4, 2006

(54) METHOD OF FABRICATING A CURRENT CONTROL DEVICE

(75) Inventors: Bruce Bower, Williamsport, PA (US); Gareth Knowles, Williamsport, PA (US)

(73) Assignee: QorTek, Inc., Williamsport, PA (US)

( * ) Notice: Subject to any disclaimer, the term of this patent is extended or adjusted under 35 U.S.C. 154(b) by 0 days.

(21) Appl. No.: 11/044,856

(22) Filed: Jan. 26, 2005

(65) Prior Publication Data

US 2006/0075629 A1 Apr. 13, 2006

Related U.S. Application Data

(62) Division of application No. 10/810,521, filed on Mar. 26, 2004, now Pat. No. 6,943,660, which is a division of application No. 10/674,712, filed on Sep. 29, 2003, now Pat. No. 6,798,332, which is a division of application No. 10/072,587, filed on Feb. 8, 2002, now Pat. No. 6,798,331.

(60) Provisional application No. 60/267,306, filed on Feb. 8, 2001.

(51) Int. Cl.
*H01C 17/28* (2006.01)

(52) U.S. Cl. ..... 29/619; 29/610.1; 29/831; 29/842; 252/519.33; 338/22 R; 338/47

(58) Field of Classification Search ..... 29/25.42, 29/592.1, 610.1, 619, 831, 832; 252/62.3 T, 252/62.3 Q, 62.9 PZ, 519.33; 338/22 R, 338/47, 99, 101, 104–106, 110–114; 361/58
See application file for complete search history.

(56) References Cited

U.S. PATENT DOCUMENTS

| | | | | |
|---|---|---|---|---|
| 5,043,622 | A * | 8/1991 | Sagong et al. | 29/25.35 |
| 5,260,848 | A * | 11/1993 | Childers | 361/127 |
| 5,414,403 | A * | 5/1995 | Greuter et al. | 338/22 R |
| 5,416,462 | A * | 5/1995 | Demarmels et al. | 338/22 R |
| 6,094,337 | A * | 7/2000 | Ueda et al. | 361/311 |
| 6,133,820 | A * | 10/2000 | Duggal et al. | 338/99 |
| 6,292,338 | B1 * | 9/2001 | Bernhoff et al. | 361/58 |

* cited by examiner

*Primary Examiner*—Minh Trinh
*Assistant Examiner*—Donghai D. Nguyen
(74) *Attorney, Agent, or Firm*—Michael Crilly, Esq.

(57) ABSTRACT

A method of fabricating a current control device is presented. The method impregnates a pressure conduction composite within a current control device with a fluid additive via suffusion. The suffusion process is performed by placing the pressure conduction composite within a bath of a liquid additive. The method generally includes the steps of mixing a compressible non-conductive matrix and conductive filler, forming a pressure conduction composite composed of the non-conductive matrix having the conductive filler electrically isolated therein, suffusing the composite within a bath so as to impregnate the composite with an additive, and attaching a pair of conductive plates to the composite. Alternate methods include attaching non-conductive plates to the composite, forming pores within the pressure conduction composite, and inserting a temperature responsive material into a porous composite.

5 Claims, 6 Drawing Sheets

METHOD OF FABRICATING A CURRENT CONTROL DEVICE

CROSS REFERENCE TO RELATED APPLICATIONS

This application is a divisional of application Ser. No. 10/810,521, filed on Mar. 26, 2004, now U.S. Pat. No. 6,943,660, which is a divisonal application of application Ser. No. 10/674,712, filed on Sep. 29, 2003, now U.S. Pat. No. 6,798,332, which is a divisional application Ser. No. 10/072,587, filed on Feb. 8, 2002, now U.S. Pat. No. 6,798,331, and claims the benefit of U.S. Provisional Application No. 60/267,306, filed on Feb. 8, 2001. The subject matters of the prior applications are incorporated in their entirety herein by reference thereto.

FEDERALLY SPONSORED RESEARCH OR DEVELOPMENT

This invention was made with government support under Contract No. N00024-01-C-4034 awarded by the United States Navy.

BACKGROUND OF THE INVENTION

1. Field of the Invention

The present invention generally relates to a method of fabricating a current control device capable of regulating current flow via compression and expansion of a variably resistive composite.

2. Related Arts

Mechanical circuit breakers are best described as a switch wherein a contact alters the electrical impedance between a source and a load. Mechanical breakers include a snap-action bimetal-contact, a mechanical latch/spring, or an expansion wire. Presently known devices are neither gapless nor shock resistant and therefore prone to chatter and arcing which cause substantial problems in many high-voltage applications.

Variably conductive composites are applicable to current control devices. Compositions include positive temperature coefficient resistive (PTCR), polymer current limiter (PCL), and piezoresistive formulations. PTCR and PCL applications and compositions and piezoresistive compositions are described in the related arts.

Anthony, U.S. Pat. No. 6,157,528, describes and claims a polymer fuse composed of a PTCR composition exhibiting temperature-dependent resistivity wherein low resistivity results below and high resistivity results above a transition temperature.

PTCR composites are composed of a conductive filler within a polymer matrix and an optional non-conductive filler. Chandler et al., U.S. Pat. No. 5,378,407, describes and claims a PTCR composite including a crystalline polymer matrix, nickel conductive filler, and dehydrated metal-oxide non-conductive filler. Sadhir et al., U.S. Pat. No. 5,968,419, describes and claims a PTCR composite including an amorphous polymer matrix, thermoplastic non-conductive filler, and conductive filler. During a fault, the composite heats thereby increasing volumetrically until there is sufficient separation between particles composing the conductive filler so as to interrupt current flow. Thereafter, the composite cools and shrinks restoring conduction. This self-restoring feature limits PTCR compositions to temporary interrupt devices.

PCL composites, like PTCR compositions, are a mixture of a conductive filler and a polymer. However, PCL composites are conductive when compressed and interrupt current flow by polymer decomposition. For example, Duggal et al., U.S. Pat. No. 5,614,881, describes a composite including a pyrolytic-polymer matrix and electrically conductive filler. During a fault, temperature within the composite increases causing limited decomposition and evolution of gaseous products. Current flow is interrupted when separation occurs between at least one electrode and conductive polymer. Gap dependent interrupt promotes arcing and arc related transients. Furthermore, static compression of the composites increases time-to-interrupt by damping gap formation. Neither PTCR nor PCL applications provide for the dynamically-tunable compression of a composite in response to electrical load conditions.

Piezoresistive composites, also referred to as pressure conduction composites, exhibit pressure-sensitive resistivity rather than temperature or decomposition dependence. Harden et al., U.S. Pat. No. 4,028,276, describes piezoresistive composites composed of an electrically conductive fill within a polymer matrix with an optional additive. Conductive particles comprising the conductive filler 2 are dispersed and separated within the non-conductive matrix 3, as represented in FIGS. 1*a* and 1*c*. Consequently, piezoresistive composites are inherently resistive becoming less resistive and more conductive when compressed by a force 9. Compression reduces the distance between conductive particles thereby forming a conductive pathway, as represented in FIGS. 1*b* and 1*d*. The composite is again resistive after the compressive force is removed. However, known piezoresistive compositions resist compression.

Pressure-based interrupt facilitates a more rapid regulation of current flow as compared to PTCR and PCL systems. Temperature dependent interrupt is slowed by the poor thermal conduction properties of the polymer matrix. Decomposition dependent interrupt is a two-step process requiring both gas evolution and physical separation between electrode and composite. Furthermore, decomposition limits the life cycle of a composition.

Active materials, including but not limited to piezoelectric, piezoceramic, electrostrictive, magnetostrictive, and shape-memory alloy materials, are ideally suited to the controlled compression of piezoresistive composites, thereby achieving rapid and/or precise changes to resistivity. Active materials facilitate rapid movement by mechanically distorting or resonating when energized. High-bandwidth active materials are both sufficiently robust to exert a large mechanical force and sufficiently precise to controllably adjust force magnitude.

Accordingly, what is required is a method of fabricating a current control device having a pressure-dependent conduction therein that is less resistive to compression and which avoids the arcing and transient spikes typical of the related arts.

SUMMARY OF THE INVENTION

An object of the present invention is to provide a method of fabricating a current control device composed of a pressure-dependent conductive composite that is less resistive to compression.

The present method impregnates a pressure conduction composite with a fluid additive via suffusing the pressure conduction composite within a fluid bath. The method includes the steps of mixing a compressible non-conductive matrix and conductive filler, forming a pressure conduction composite composed of the compressible non-conductive matrix having the conductive filler electrically isolated therein, suffusing the composite within a bath so as to impregnate the composite with an additive, and attaching a pair of conductive plates to the composite.

The present method provides a pressure conduction composite having a nearly infinite life cycle.

BRIEF DESCRIPTION OF THE DRAWINGS

The invention will now be described in more detail, by way of example only, with reference to the accompanying drawings, in which.

REFERENCE NUMERALS

Figure 1A:
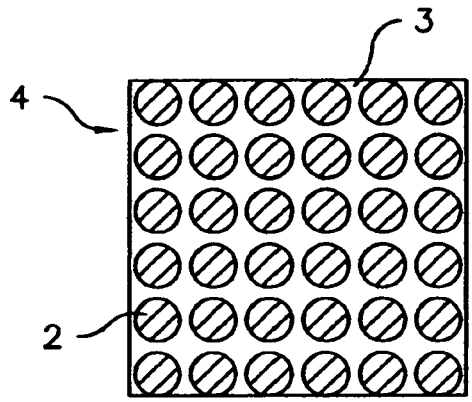
FIGS. 1*a*–1*d* are schematic diagrams showing exemplary composite microstructures before and after compression.
Figure 1B:
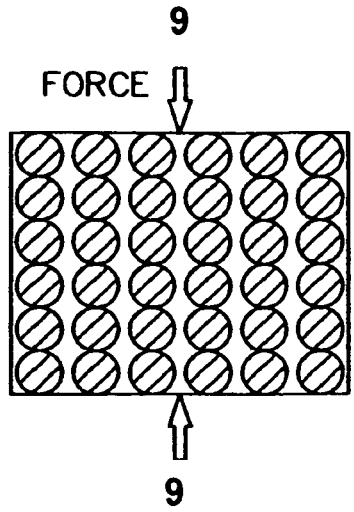
Figure 1C:
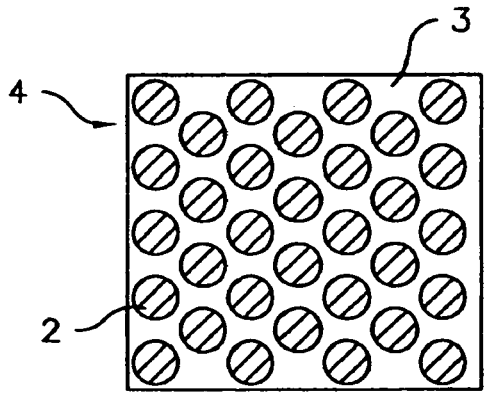
Figure 1D:
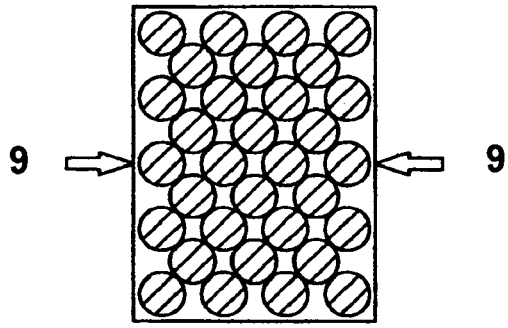

1 Current control device
2 Conductive filler
3 Non-conductive matrix
4 Composite
5*a*–5*b* Pressure plate
6 First electrode
7 Second electrode
8*a*–8*b* Actuator
9 Force
10 Cavity
11 Temperature sensitive material

DESCRIPTION OF THE INVENTION

Figure 2A:
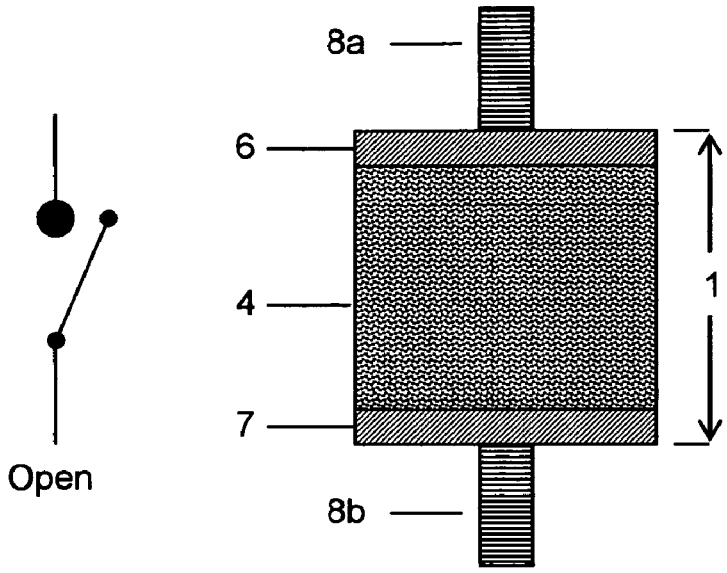
FIGS. 2*a*–2*b* are side elevation views of an exemplary current control device with conductive pressure plates.
Figure 2B:
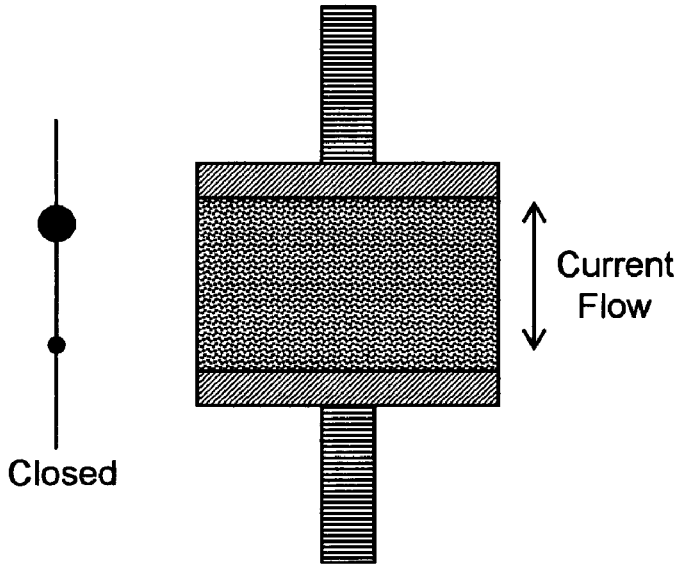
Figure 3A:
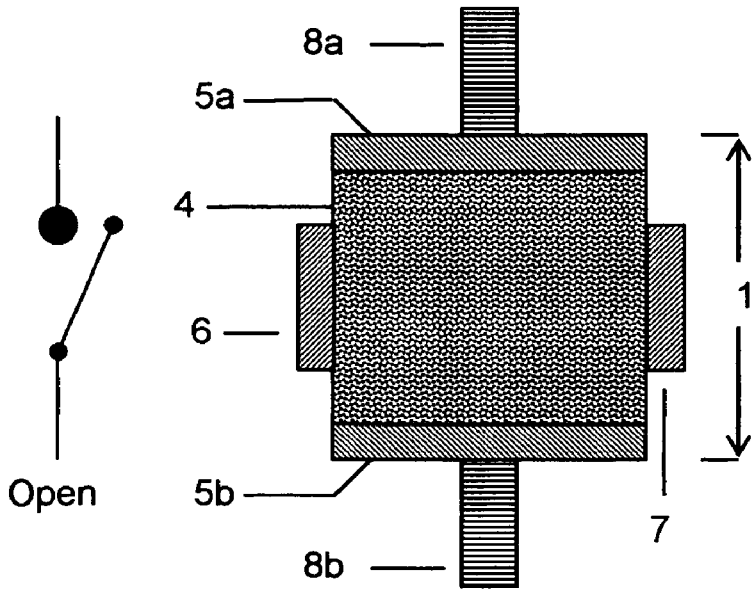
FIGS. 3*a*–3*b* are side elevation views of an exemplary current control device with non-conductive pressure plates.
Figure 3B:
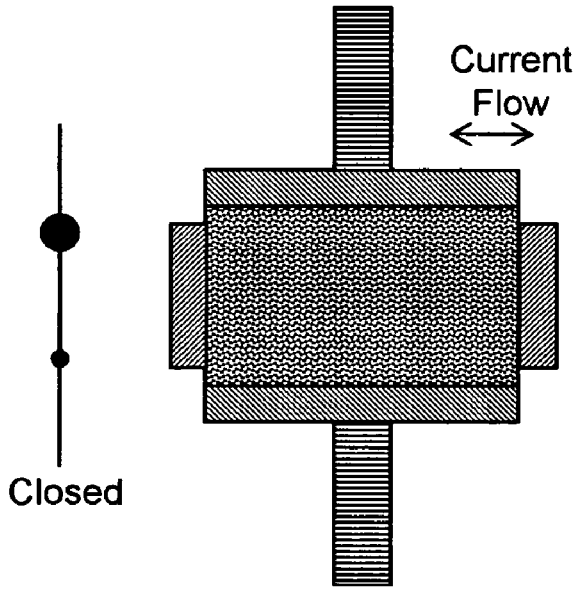

Referring now to FIGS. 2*a* and 3*a*, two embodiments of a current control device 1 are shown having a rectangular solid composite 4 contacting and sandwiched between two or more plates, namely a planar first electrode 6 and planar second electrode 7, and a planar first electrode 6, planar second electrode 7 and two planar pressure plates 5*a*, 5*b*.

The composite 4 functionally completes the current path between first electrode 6 and second electrode 7 during acceptable operating conditions and interrupts current flow when a fault condition occurs. The composite 4 is either conductive or resistive based on the pressure state within the composite 4. For example, the composite 4 may be conductive above and non-conductive below a threshold pressure. Alternately, the resistivity of the composite 4 may vary with pressure over a range of resistance values.

The composite 4 is composed of a non-conductive matrix 3 and a conductive filler 2, as schematically represented in FIGS. 1*a*–1*d*, and impregnated with a fluid additive. Preferred formulations include a non-conductive matrix 3 and a conductive filler 2, the latter randomly dispersed within the non-conductive matrix 3, at a volume fraction below the percolation threshold of the material system. During compression, the non-conductive matrix 3, separating the conductive filler 2, is dimensionally reduced thereby crossing the percolation threshold.

The non-conductive matrix 3 is a resistive, yet compressible material including but not limited to polymers and elastomers. Specific examples include polyethylene, polystyrene, polyvinyldifluoride, polyimide, epoxy, polytetrafluorethylene, silicon rubber, polyvinylchloride, and combinations thereof Preferred embodiments were composed of the elastomer RTV R3145 manufactured by the Dow Corning Company.

The conductive filler 2 is an electrically conductive material including but not limited to metals, metal-based oxides, nitrides, carbides, and borides, and carbon black. Preferred fillers resist deformation under compressive loads and have a melt temperature sufficiently above the thermal conditions generated during current interrupt. Specific metal examples include aluminum, gold, silver, nickel, copper, platinum, tungsten, tantalum, iron, molybdenum, hafnium, combinations and alloys thereof Other example fillers include Sr(Fe, Mo)O3, (La,Ca)MnO3, Ba(Pb,Bi)O3, vanadium oxide, antimony doped tin oxide, iron oxide, titanium diboride, titanium carbide, titanium nitride, tungsten carbide, and zirconium diboride.

Figure 4:
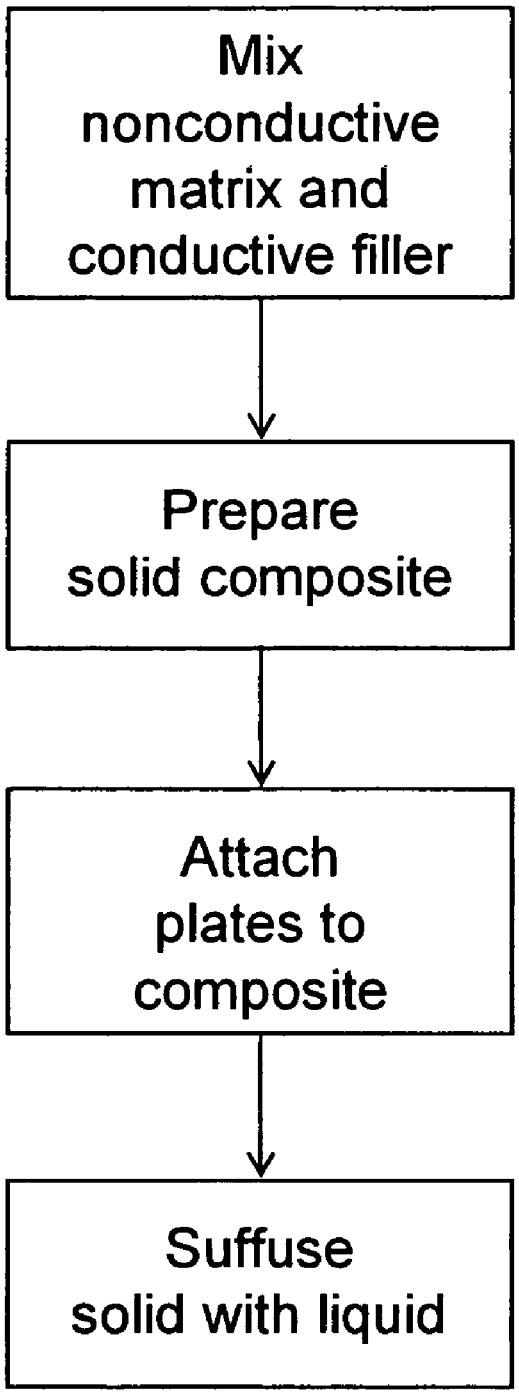
FIG. 4 is a flowchart of an exemplary method of fabrication.

Referring now to FIG. 4, a preferred fabrication methodology is described for the composite 4 and current control device 1. The composite 4 is prepared from high-purity feedstocks which are mixed, formed into a solid, and suffused with oil. One or more plates are adhered to the composite 4.

Feedstocks include both powders and liquids. Feedstock comprising the conductive filler 2 is typically a fine, uniform powder, one example being 325 mesh titanium carbide. Feedstock comprising the non-conductive matrix 3 may include either a fine, uniform powder or a liquid with sufficiently low-viscosity to achieve adequate dispersion of the powder therein. Powder-based formulations are mechanically mixed and compression molded using conventional methods. Polytetrafluorethylene formulations may require sintering within an oven to achieve a structurally durable solid. Powder-liquid formulations, one example being titanium carbide and a silicone-based elastomer, are vulcanized and hardened within a die under low uniaxial loading at room temperature.

The composite 4 is placed within a liquid bath thereby allowing infiltration of the additive into the composite 4. Additives are typically inorganic oils, prefer ably silicone-based. The composite 4 is exposed to the additive bath to insure complete suffusion of the solid, whereby exposure time is determined by dimensions and composition of the composite 4. For example, a 0.125-inch by 0.200-inch by 0.940-inch composite 4 composed of titanium carbide having a volume fraction of 66 percent and RTV R3145 having a volume fraction of 34 percent was suffused over a 48 hour period.

Conductive or non-conductive plates are adhered to the composite 4 either before or after suffusion. If prior to suffusion, plates are placed within a die along with the liquid state composite 4. For example, a silicone-based elastomer composite 4 was adequately bonded to two 0.020-inch thick brass plates by curing at room temperature between 3 to 24 hours or at an elevated temperature between 60 to 120 degrees Celsius for 2 to 10 hours. If after suffusion, silicone adhesive is applied between plate and composite 4 and thereafter mechanically pressed to allow for proper bond formation.

A porous, non-conductive matrix 3 improves compression and cooling characteristics of the composite 4 without degrading electrical properties. A porous structure is formed by mechanical methods, one example including drilling, after fabrication of the solid composite 4. Another method includes the introduction of pores during mixing of a powder-based conductive filler 2 with a liquid-based non-conductive matrix 3. An additional method includes the introduction of pores during compression forming the composite 4. Also, pores may be formed by heating the composite 4 within an oven resulting in localized heating or phase transitions that result in void formation and growth. Furthermore, highly compressible microspheres composed of a low-density, high-temperature foam may be introduced during mixing. Pores are either randomly oriented or arranged in a repeating pattern. Pore shapes include but are not limited to spheres, cylinders, and various irregular shapes. A single pore may completely traverse the thickness of a composite 4.

Figure 5:
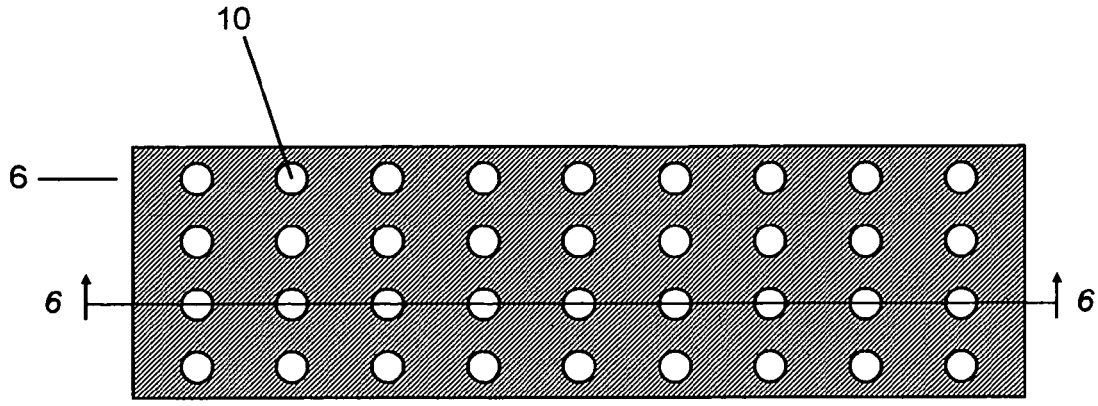
FIG. 5 is a top elevation view of an exemplary current control device showing cylindrically-shaped pores through an electrode.
Figure 6:
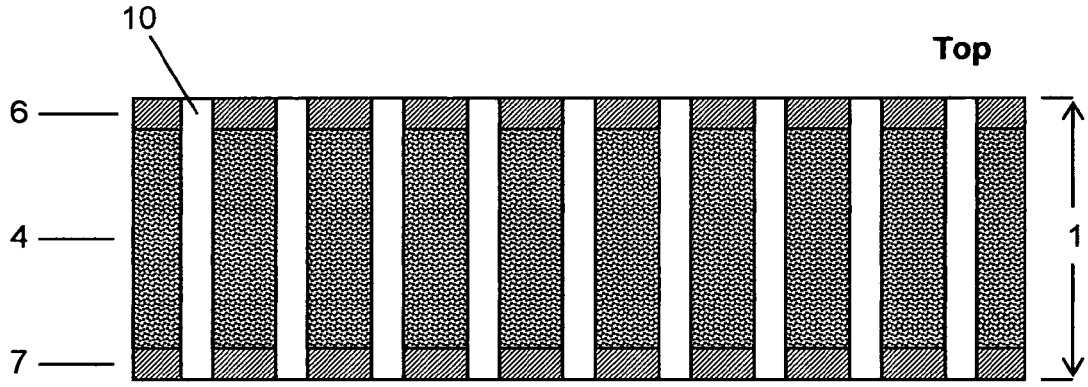
FIG. 6 is a section view of an exemplary current control device showing cylindrically-shaped cavities through the thickness of both composite and electrodes.
Figure 7:
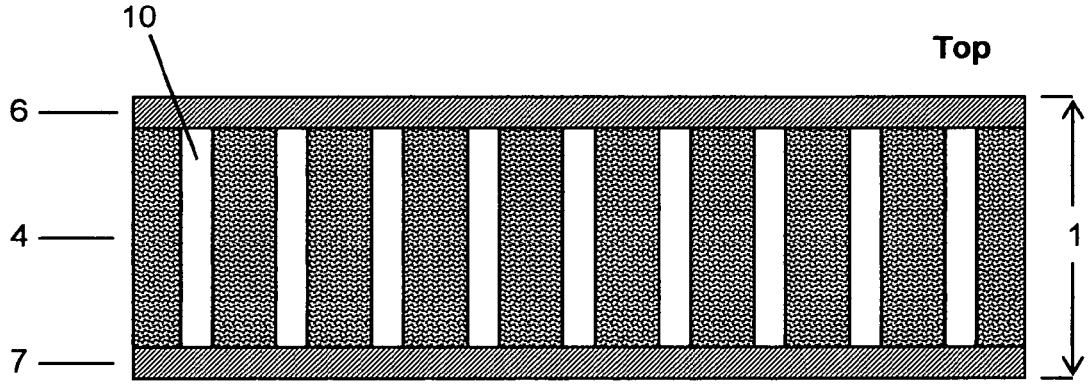
FIG. 7 is a section view of an exemplary current control device showing cylindrically-shaped cavities through the thickness of the composite.

FIGS. 5–6 show an embodiment wherein a plurality of pores comprised of cavities 10 traverse the cross section of a current control device 1 to include both composite 4 and first and second electrodes 6, 7. FIG. 7 shows an embodiment wherein cavities 10 traverse the composite 4 within the current control device 1.

Figure 8A:
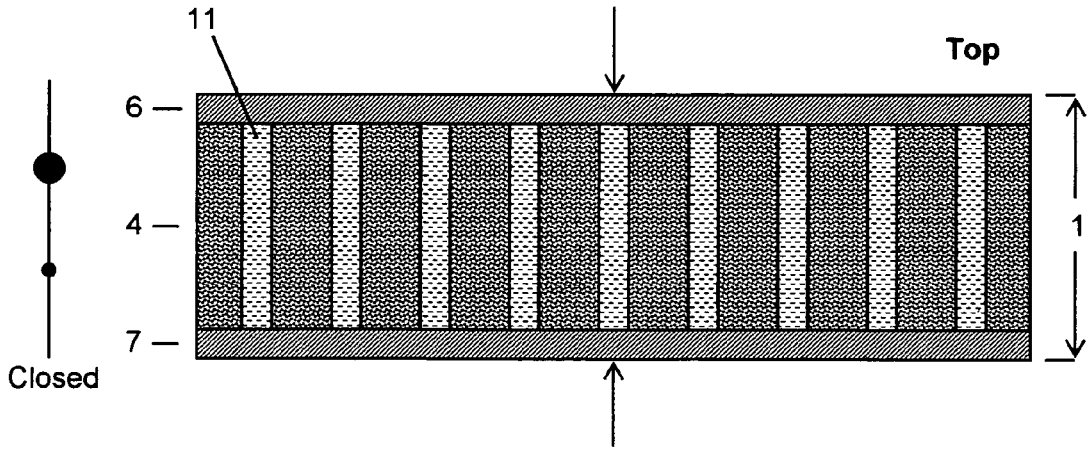
FIGS. 8*a*–8*b* are section views of an exemplary current control device showing cylindrically-shaped cavities filled with a temperature sensitive material.
Figure 8B:
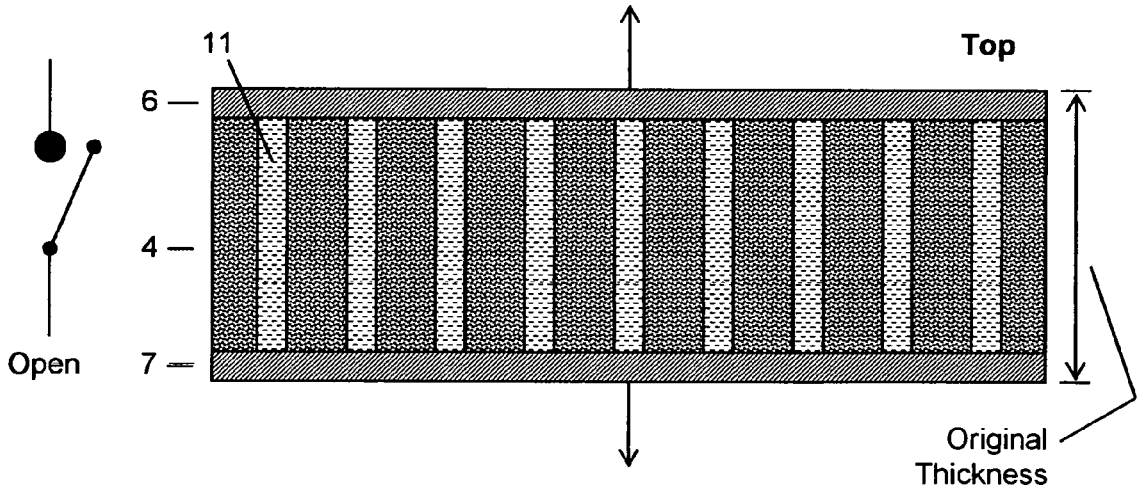

FIGS. 8*a*–8*b* show another embodiment wherein cavities 10 are filled with a temperature sensitive material 11, examples including rods or springs composed of a shape memory alloy. Functionally, the temperature sensitive material 11 is typically a rubbery material below and hard above a phase transition temperature as represented in FIGS. 8*a* and 8*b*, respectively. The temperature sensitive material 11 produces a large force above a transition temperature designed within the material, as would readily understood within the art. This force is sufficiently capable of moving the pressure plates 5*a*, 5*b* or first and second electrodes 6, 7 apart thereby interrupting current flow. The temperature sensitive material 11 is self restoring thereby facilitating current flow after the surrounding composite 4 has cooled.

Referring again to FIGS. 2*a*–2*b* and 3*a*–3*b*, actuators 8*a*, 8*b* are rigid beam-like elements composed of an active material capable of dimensional variations when electrically activated. For example, actuators 8*a*, 8*b* may extend, contract, or extend and contract. Extension of the actuators 8*a*, 8*b* increases their overall length.

In preferred embodiments, actuators 8*a*, 8*b* are composed of piezoelectric, piezoceramic, electrostrictive, magnetostrictive, or shape memory alloy materials. For example, piezoelectric and piezoceramic materials may be arranged in a planar stack along the length of an actuator 8*a*, 8*b*. Shape memory alloys are mechanically distorted by heating via electrical conduction or heat conduction from an adjacent body, one example including the composite 4 during a fault condition. Alternatively, actuators 8*a*, 8*b* may include a commercially available high-speed piezo-controlled pneumatic element comprised of a pneumatic diaphragm with pilot operated high-bypass value.

The description above indicates that a great degree of flexibility is offered in terms of the present invention. Although methods have been described in considerable detail with reference to certain preferred versions thereof, other versions are possible. Therefore, the spirit and scope of the appended claims should not be limited to the description of the preferred versions contained herein.

The invention claimed is:

1. A method of fabricating a current control device comprising the steps of:

(a) mixing a non-conductive matrix and a conductive filler, said non-conductive matrix being compressible, said conductive filler being non-compressible;

(b) forming a solid composite composed of said non-conductive matrix having said conductive filler electrically isolated therein;

(c) suffusing said solid composite within a bath to allow an inorganic oil to completely infiltrate said solid composite; and (d) attaching a pair of conductive plates to said solid composite.

2. The method of claim 1, wherein said attaching step is prior to said suffusing step.

3. The method of claim 1, wherein said attaching step is after said suffusing step.

4. A method of fabricating a current control device comprising the steps of:

(a) mixing a non-conductive matrix and a conductive filler, said non-conductive matrix being compressible, said conductive filler being incompressible;

(b) hardening said non-conductive matrix about said conductive filler to form a solid composite, said conductive filler electrically isolated therein;

(c) heating said solid composite without melting said solid composite to form a plurality of pores within said non-conductive matrix after said non-conductive matrix is hardened, said heating step forming said pores via localized hrating and gas formation within said non-conductive matrix;

(d) suffusing said solid composite with pores within a bath to allow an inorganic oil to completely infiltrate said solid composite with pores;and (e) attaching a pair of conductive platrs to said porous solid composite.

5. The method of fabricating a current control device comprising the steps of:

(a) mixing a non-conductive matrix, a conductive filler, and a plurality of non-conductive microspheres comprised of a low-density, high-temperature foam, said non-conductive matrix and said non-conductive microspheres being compressible, said conductive filler being incompressible;

(b) hardening said non-conductive matrix about said conductive filler and said non-conductive microspheres to form a solid composite, said filler electrically isolated within said non-conductive matrix;

(c) suffusing said solid composite within a bath to allow an inorganic oil to completely infiltrate said solid composite; and (d) attaching a pair of conductive plates to said solid composite.

* * * * *

UNITED STATES PATENT AND TRADEMARK OFFICE

CERTIFICATE OF CORRECTION

PATENT NO. : 7,069,642 B2
APPLICATION NO. : 11/044856
DATED : July 4, 2006
INVENTOR(S) : Bruce Bower et al.

It is certified that error appears in the above-identified patent and that said Letters Patent is hereby corrected as shown below:

Column, 4, line 52
delete "prefer ably"
insert --preferably--

Column 6
Line 37: delete "hrating"; insert --heating--
Line 41: delete ";and"; insert --; and--
Line 42: delete "platrs"; insert --plates--

Signed and Sealed this

Twelfth Day of September, 2006

JON W. DUDAS
*Director of the United States Patent and Trademark Office*